US010342328B2

(12) United States Patent
Rafii

(10) Patent No.: US 10,342,328 B2
(45) Date of Patent: Jul. 9, 2019

(54) SELF-STABILIZING SYSTEM AND METHOD FOR LONG TABLE

(71) Applicant: Eddie Rafii, Laguna Niguel, CA (US)

(72) Inventor: Eddie Rafii, Laguna Niguel, CA (US)

( * ) Notice: Subject to any disclaimer, the term of this patent is extended or adjusted under 35 U.S.C. 154(b) by 0 days.

(21) Appl. No.: 15/782,640

(22) Filed: Oct. 12, 2017

(65) Prior Publication Data

US 2019/0110589 A1 Apr. 18, 2019

(51) Int. Cl.

| | |
|---|---|
| ***A47B 13/02*** | (2006.01) |
| ***A47B 13/00*** | (2006.01) |
| ***A47B 87/00*** | (2006.01) |
| ***A47B 13/06*** | (2006.01) |

(52) U.S. Cl.

CPC ..... *A47B 13/021* (2013.01); *A47B 13/003* (2013.01); *A47B 13/06* (2013.01); *A47B 87/002* (2013.01); *A47B 2013/022* (2013.01)

(58) Field of Classification Search

CPC ..... A47B 91/16; A47B 13/021; A47B 13/003; A47B 87/002

USPC ..... 108/155, 153.1, 50.01, 50.02, 147; 248/188.3, 188.2

See application file for complete search history.

(56) References Cited

U.S. PATENT DOCUMENTS 2,787,087 A * 4/1957 Whitman ..... A47B 91/16 108/150
2,793,468 A * 5/1957 Mooser ..... A47B 91/16 248/188.3
2,865,696 A * 12/1958 Mooser ..... A47B 91/16 108/8
3,278,147 A * 10/1966 Olander ..... D06F 81/00 248/188.3
4,053,129 A * 10/1977 Graff ..... A47C 7/004 16/42 R
4,456,095 A * 6/1984 Hodson ..... E06C 7/426 182/15
5,370,063 A * 12/1994 Childers ..... A47B 9/06 108/143
5,513,825 A 5/1996 Gutgsell
5,685,510 A * 11/1997 Frankish ..... A47B 9/04 108/147
5,690,303 A * 11/1997 Winters ..... A47B 91/00 248/188.3
6,009,815 A 1/2000 Hartman
6,209,465 B1 4/2001 Brooks
(Continued)

*Primary Examiner* — Jose V Chen

(74) *Attorney, Agent, or Firm* — FisherBroyles, LLP; Rob L. Phillips

(57) ABSTRACT

An integral system for stabilizing a long table on an uneven surface. One version includes two spaced supports with each of the supports comprising a vertical member. One horizontal platform attaches to an upper portion of one of the supports and an underside of the table top and a second horizontal platform affixed to a post and attached to the underside of the table top. The post is insertable into the vertical member of the other support and movably joined at a first end thereto such that the post may move side-to-side, in a rocking manner relative to the vertical member stabilizing the table. Another version includes a table having two spaced supports each with a horizontal member and a stabilizing member configured to slip over one horizontal member and movably connect thereto. When attached, the stabilizing member may rock about the connection point with the horizontal member.

17 Claims, 7 Drawing Sheets

(56) References Cited

U.S. PATENT DOCUMENTS

| | | | | |
|---|---|---|---|---|
| 6,360,675 | B1 * | 3/2002 | Jones | A47B 9/00 108/50.02 |
| 6,705,239 | B2 * | 3/2004 | Doyle | A47B 9/04 108/147 |
| 7,204,193 | B2 * | 4/2007 | Scherrer | A47B 9/10 108/147 |
| 8,162,273 | B2 * | 4/2012 | Jones | B25H 1/18 182/107 |
| 8,596,598 | B2 * | 12/2013 | Lai | B25H 1/16 108/146 |
| 8,870,134 | B2 * | 10/2014 | Catoni | A47B 91/16 108/155 |
| 2002/0096617 | A1 * | 7/2002 | Marcotte | E01F 9/688 248/548 |
| 2003/0230681 | A1 * | 12/2003 | Gwynneth | A47B 91/16 248/188.3 |
| 2005/0151037 | A1 | 7/2005 | Oxley | |
| 2007/0252053 | A1 | 11/2007 | Brooke | |
| 2007/0272638 | A1 * | 11/2007 | Berg | A47B 91/16 211/182 |
| 2008/0178779 | A1 * | 7/2008 | Agee | A47B 9/04 108/147 |
| 2010/0071599 | A1 * | 3/2010 | McEntire | A47B 13/02 108/50.11 |
| 2012/0085873 | A1 | 4/2012 | Brooke | |
| 2013/0036950 | A1 | 2/2013 | Heyring et al. | |
| 2016/0081468 | A1 * | 3/2016 | Molteni | A47B 9/00 108/147 |
| 2016/0178114 | A1 * | 6/2016 | Hoyle | A47B 3/06 248/188.3 |
| 2017/0135466 | A1 * | 5/2017 | Randlov | A47B 9/20 |

* cited by examiner

SELF-STABILIZING SYSTEM AND METHOD FOR LONG TABLE

FIELD OF THE INVENTION

The embodiments of the present invention relate to a long table incorporating a self-stabilizing system for preventing a table and chair from rocking.

BACKGROUND

Table tops, especially those associated with tables used in restaurants and other commercial outlets, are ideally stable such that articles placed on a table top thereof remain steady. Moreover, a table which constantly shifts on an uneven surface is very disruptive for those seated thereabout. Solutions including the placement of folded paper under one leg of the table are simply ineffective.

Accordingly, it would be beneficial to develop a new, automatic system for stabilizing a table top associated with a table on an uneven surface.

SUMMARY

The embodiments of the present invention are directed to an integral system for stabilizing a table on an uneven surface. In one embodiment, the table comprises a table top supported by two spaced supports proximate opposite edges of the table, each of said supports comprising a vertical member with at least a pair of legs extending from proximate a bottom thereof; a first horizontal platform attached to an upper portion of one of said supports and an underside of said table top; a second horizontal platform affixed to a post and attached to said underside of said table top, said post inserted into said vertical member of said second one of said supports and movably joined at an upper end to said vertical member; and wherein said post may move side-to-side in a rocking manner relative to said vertical member stabilizing said table.

In one embodiment, the connection between the vertical shaft and post may be tightened and loosened to adjust the forces required to permit the rocking movement of the post within the vertical member.

In another embodiment the table comprises a table top supported by two spaced supports proximate opposite edges of the table, each of said supports comprising a pair of legs separated by a horizontal member affixed to an underside of said table top; and a stabilizing member affixed to an underside of said table top and movably joined to one of said horizontal members of said two spaced supports such that said stabilizing member may pivot about a connection point to said one of said horizontal members of said two spaced supports.

In another embodiment, the table comprises a table top supported by multiple spaced supports including at least two independent vertical supports attached to an underside said table top and a third support comprising a pair of legs separated by a horizontal member attached to an underside of said table top; a stabilizing member affixed to an underside of said table top and movably attached to said third support such that said stabilizing member may pivot relative to said horizontal member.

Other variations, embodiments and features of the present invention will become evident from the following detailed description, drawings and claims.

DETAILED DESCRIPTION

Figure 1:
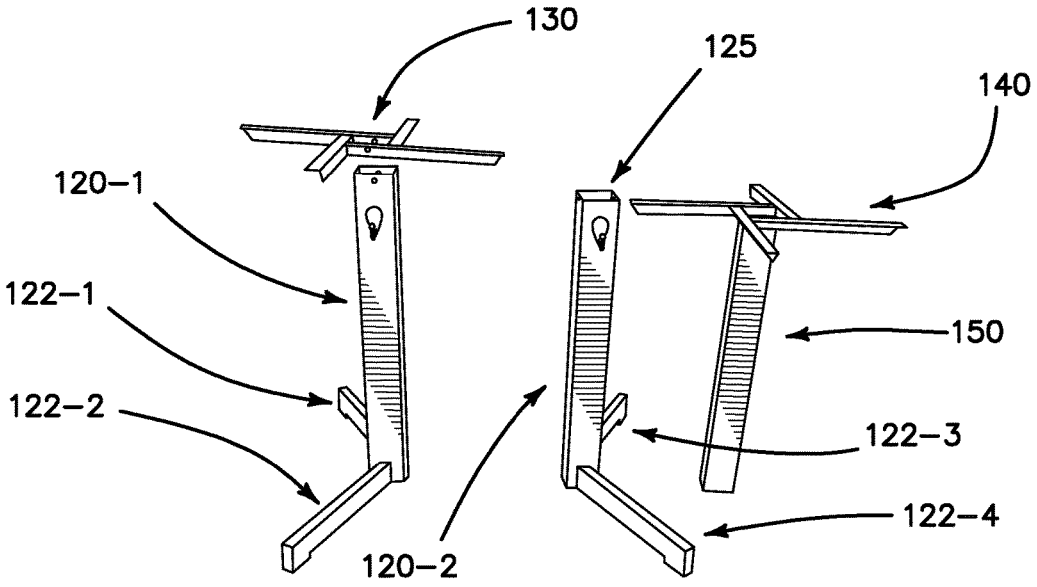
FIG. 1 illustrates components of a first table self-stabilizing system according to the embodiments of the present invention.
Figure 2:
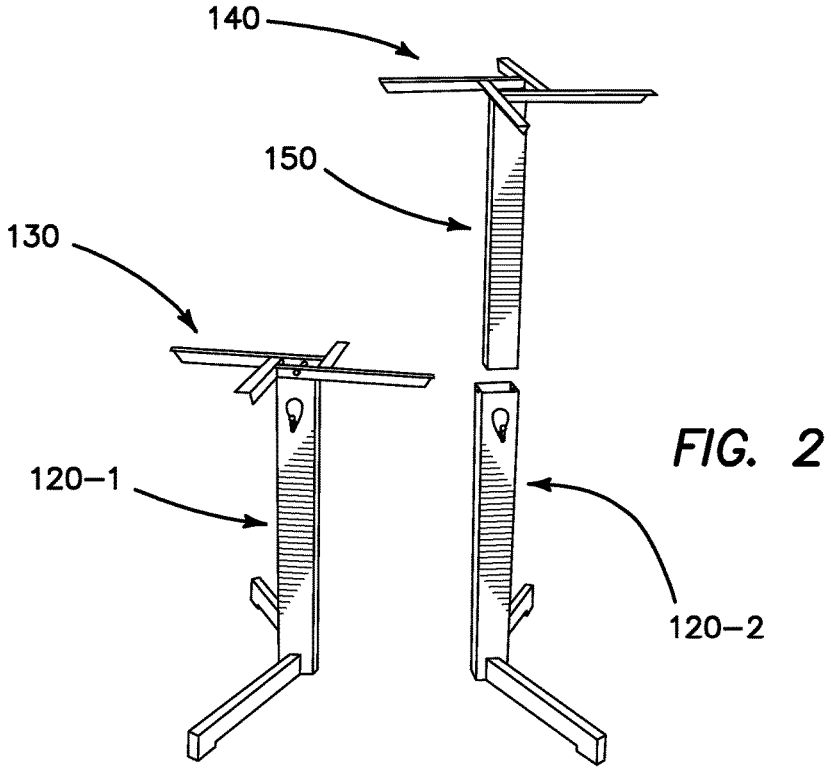
FIG. 2 illustrates the components of the first table self-stabilizing system being assembled according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIGS. 1-4 show a first embodiment of a self-stabilizing table 100 and components thereof according to the embodiments of the present invention. The table 100 comprises broadly a table top 110 supported by two spaced supports 120-1, 120-2, a first horizontal platform 130 and second horizontal platform 140 affixed to a post 150. A pair of legs 122-1 through 122-4 extend from each of said two supports 120-1, 120-2. The first horizontal platform 130 is configured to attach to an upper portion of a first one of said supports 120-1 and underside of said table top 110. The second horizontal platform 140 is affixed to the post 150 and configured to attach to said underside of said table top 110. As shown, the horizontal platforms 130, 140 are formed by four L-shaped members joined to one another. Other platform designs may be used as well.

Figure 3:
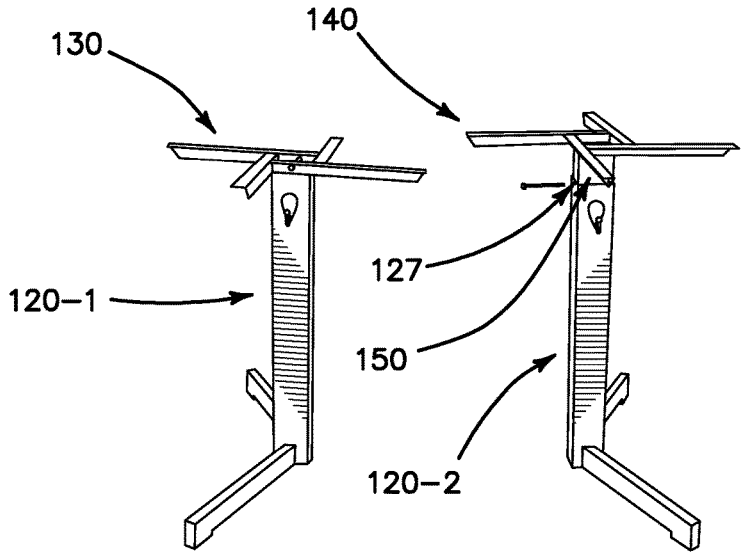
FIG. 3 illustrates the components of the first table self-stabilizing system being further assembled according to the embodiments of the present invention.

Said post 150 is dimensioned to insert into a vertical shaft 125 defined by said support 120-2. FIG. 3 shows the post 150 being inserted into the vertical shaft 125. Once inserted, the post 150 is movably joined at an upper end to said vertical shaft 125 such that said post 150 may move side-to-side, in a rocking manner within and relative to said vertical shaft 125 to stabilize said table 100. In other words, the post 150 can swing (with application of a threshold pressure) about the connection point 127 within the vertical shaft 125. Loosening and tightening the connection point (e.g., nut and bolt combination), alters the necessary threshold pressure required to move/adjust the position of post 150 within the vertical shaft 125.

Figure 4:
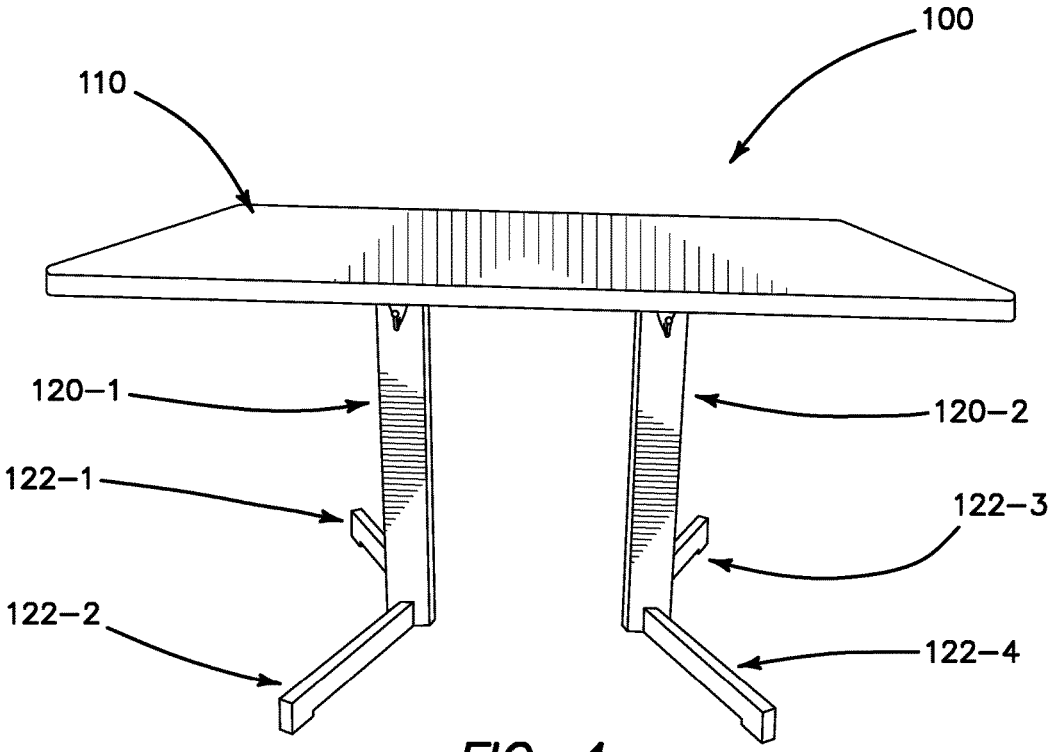
FIG. 4 illustrates the first table self-stabilizing system fully assembled according to the embodiments of the present invention.
Figure 5A:
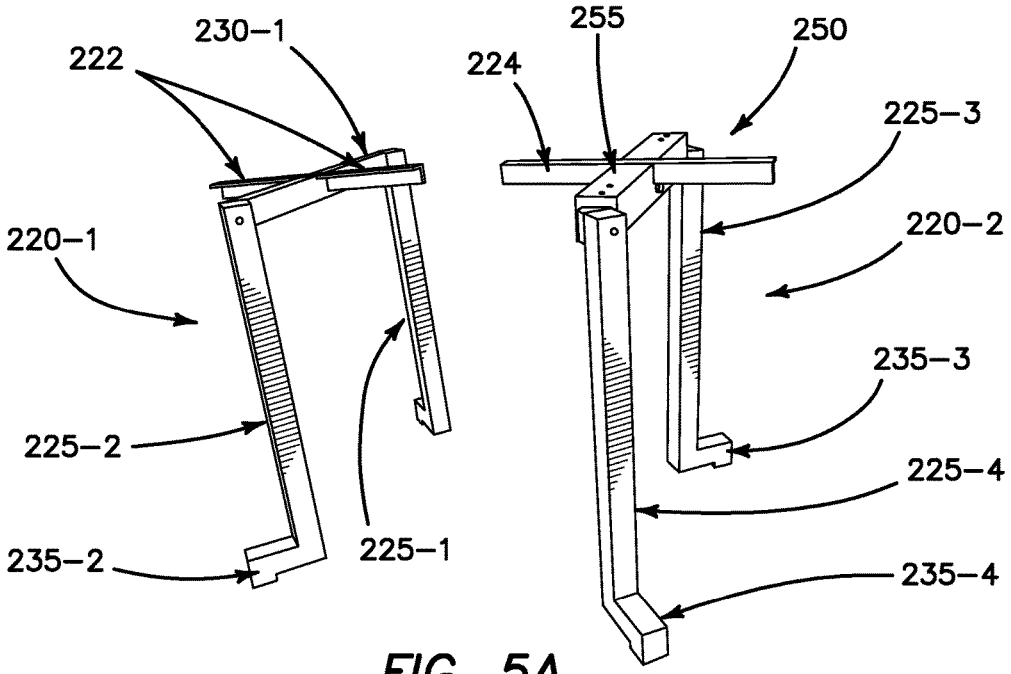
FIG. 5A illustrates a perspective side view of components of a second table self-stabilizing system according to the embodiments of the present invention
Figure 5B:
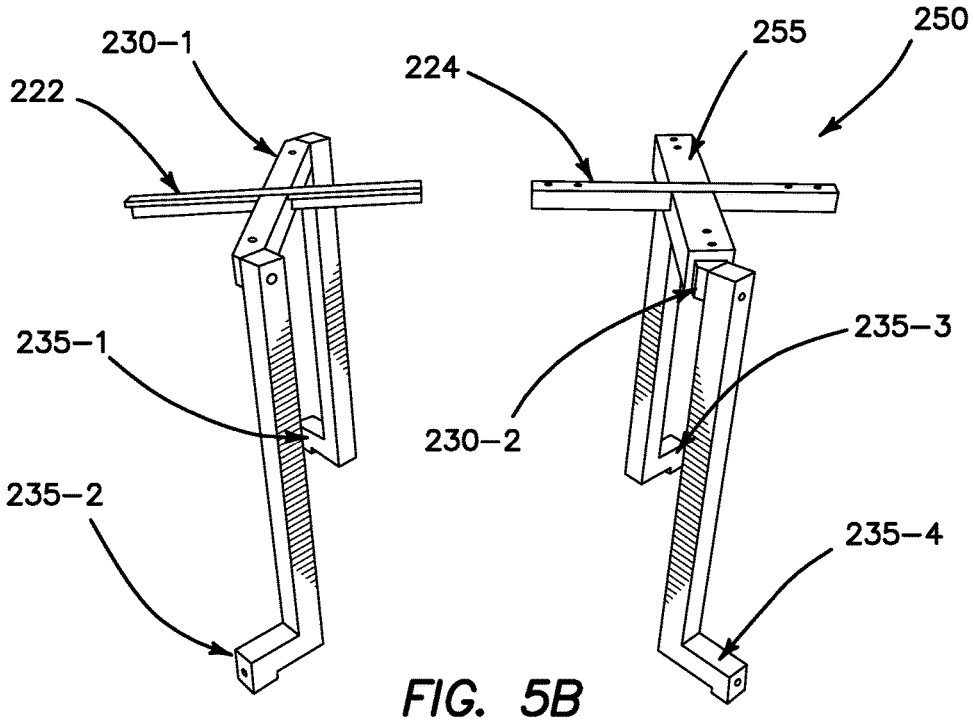
FIG. 5B illustrates a perspective upper view components of a second table self-stabilizing system according to the embodiments of the present invention

This ability of the post 150 to move permits the table top 100 to be stabilized responsive to the table 100 sitting on an uneven surface. FIG. 4 shows the table 100 on an uneven surface caused by leg 122-2 resting on a wood square. As shown, the other three legs 120-1, 120-3 and 120-4 are resting on the ground given the ability of the post 150 to move within vertical shaft 125. In this manner, the table 100 does not wobble based on interactions with patrons arranged thereabout.

FIGS. 5A-6D show a second embodiment of a self-stabilizing table 200 and components thereof according to the embodiments of the present invention. The table 200 comprises broadly a table top (not shown) supported by two spaced supports 220-1, 220-2 each having two legs 225-1 through 225-4 and a horizontal member 230-1, 230-2 (best seen in FIG. 6A). Each leg 225-1 through 225-4 may include a foot 235-1 through 235-4. Support 220-1 further includes a cross-member 222 to further support the table top.

A stabilizing member 250 is configured to slip over horizontal member 230-2 and movably connect thereto. The stabilizing member 250 is further attached to the underside of the table top. Stabilizing member 250 comprises a body 255 configured to slip over the horizontal member 230-2 and a cross-member 224. In one embodiment, the body 255 is U-shaped (best seen in FIG. 6A) to slip over the rectangular horizontal member 230-2. Those skilled in the art will recognize that other shapes are conceivable.

Figure 6A:
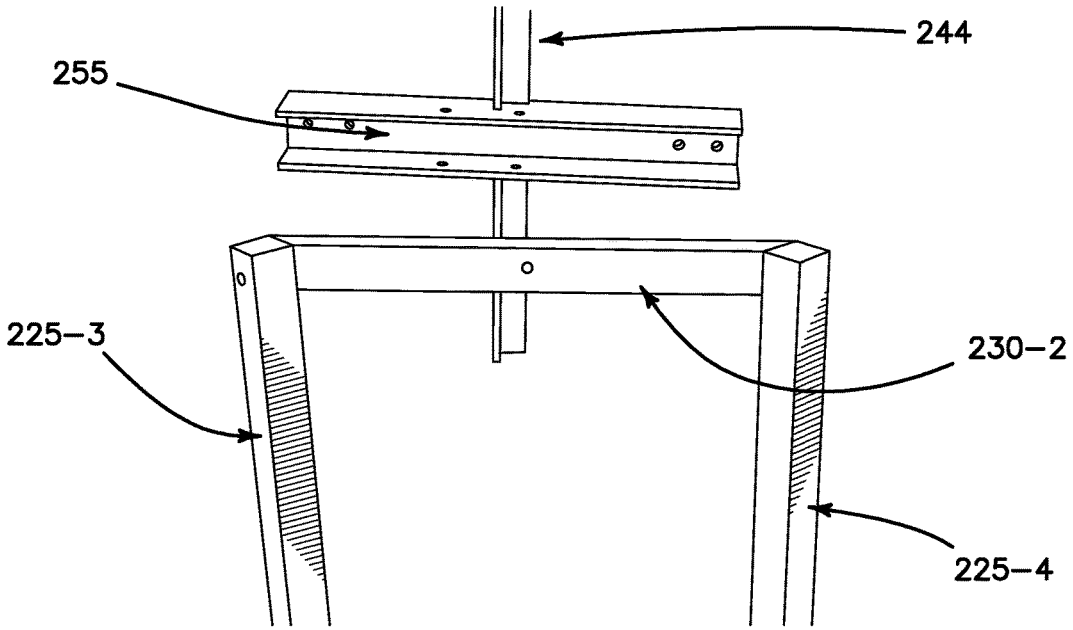
FIG. 6A illustrates the stabilizing member removed according to the embodiments of the present invention.
Figure 6B:
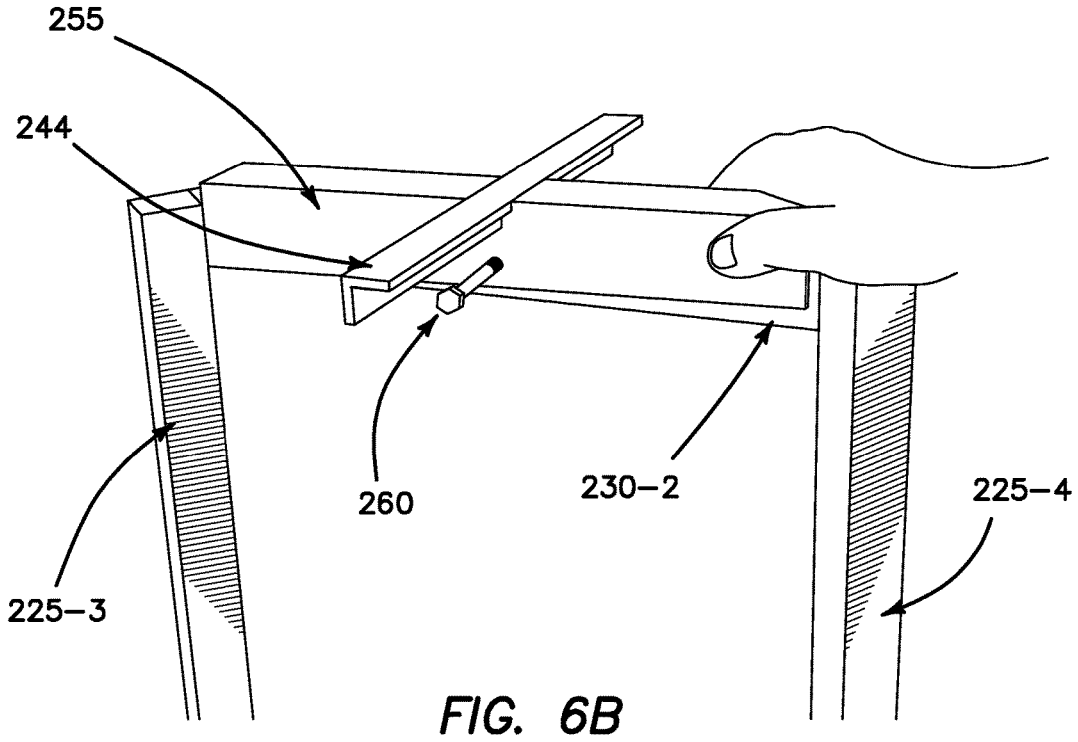
FIG. 6B illustrates the stabilizing member installed according to the embodiments of the present invention.
Figure 6C:
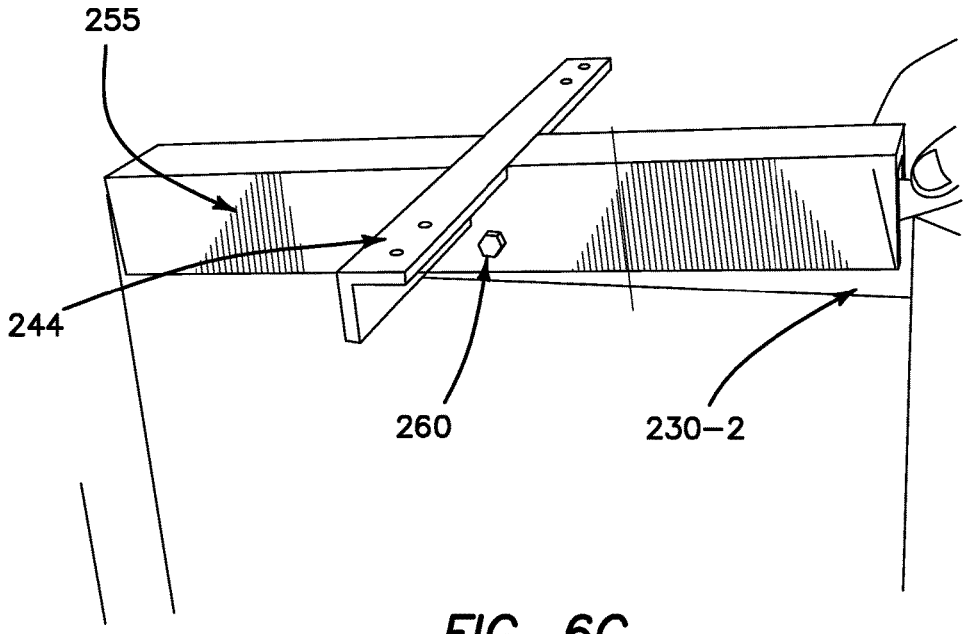
FIG. 6C illustrates the stabilizing member tilted in a first direction according to the embodiments of the present invention.
Figure 6D:
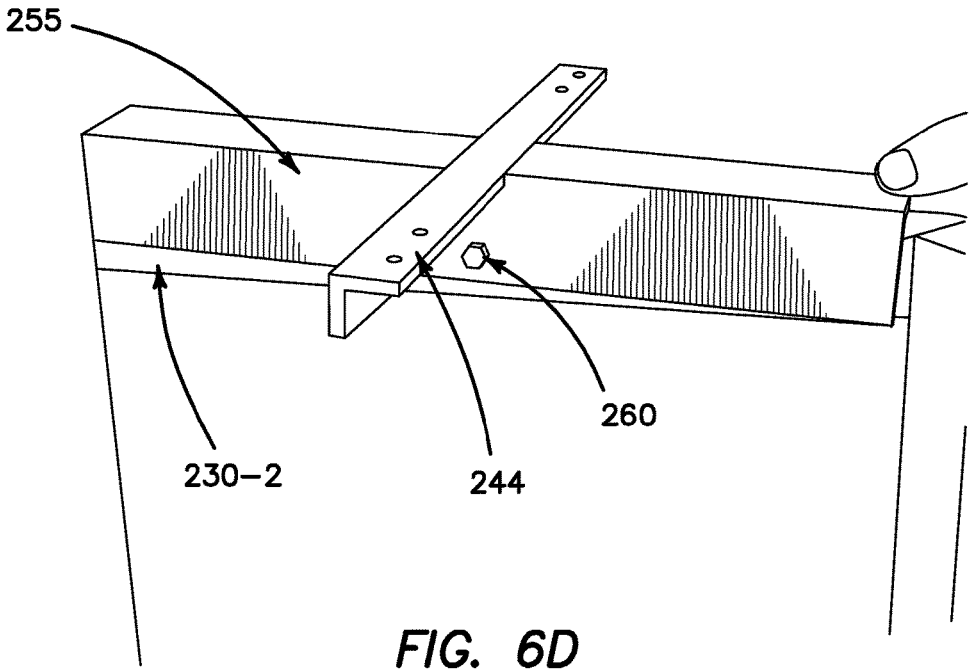
FIG. 6D illustrates the stabilizing member tilted in a second direction according to the embodiments of the present invention.

When attached, as shown in FIGS. 6B-6D, the stabilizing member 250 is able to pivot about the connection point 260 with the horizontal member 230-2. The rocking motion of the stabilizing member 250 stabilizes the table 200 when on uneven ground.

Figure 7:
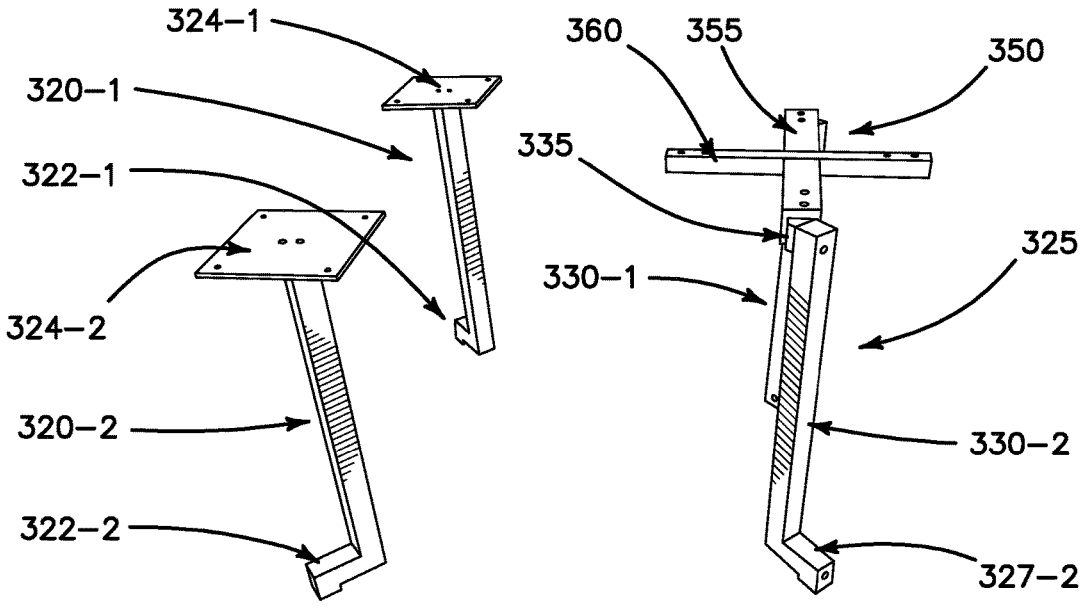
FIG. 7 illustrates components of a third table self-stabilizing system according to the embodiments of the present invention.
Figure 8:
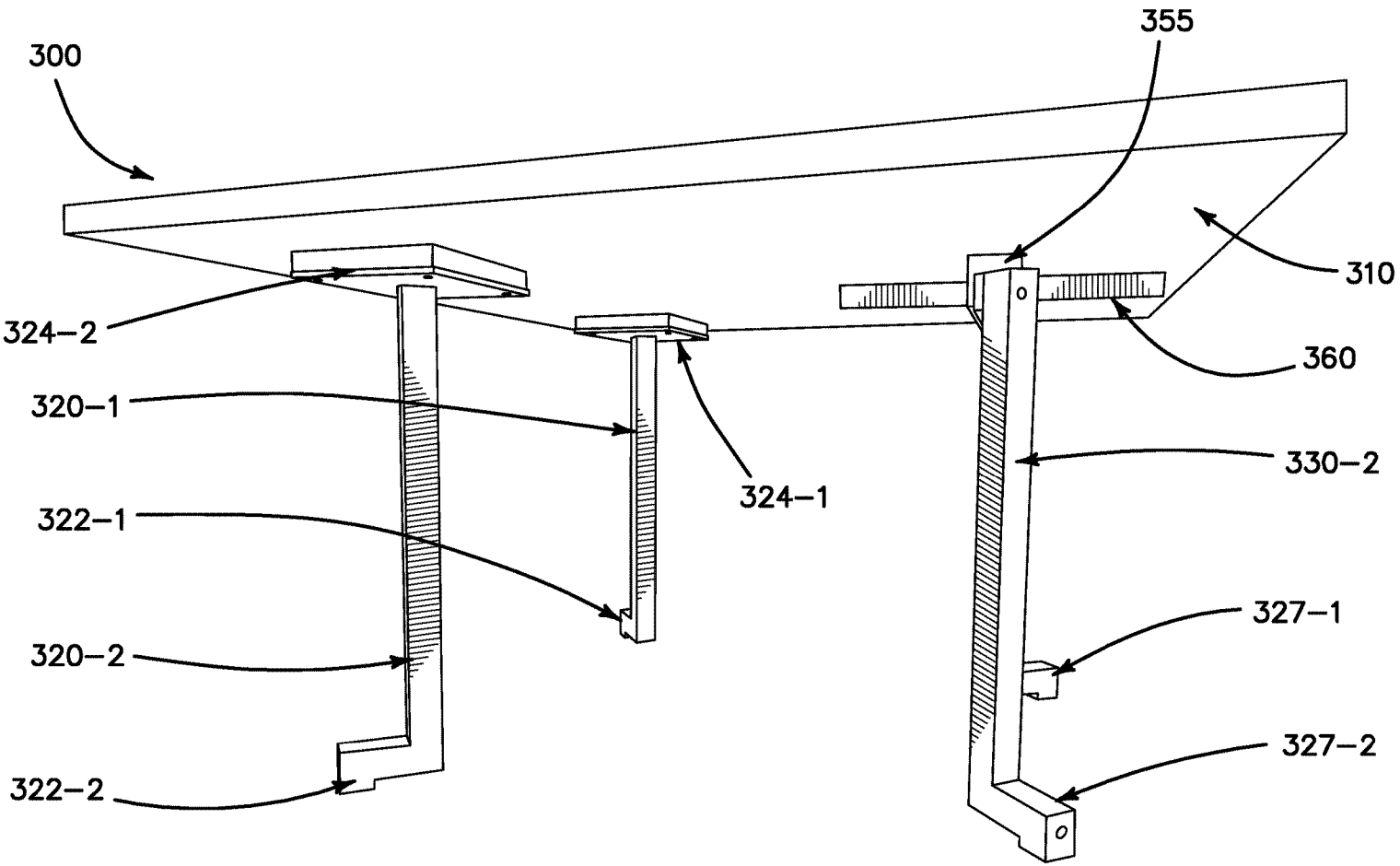
FIG. 8 illustrates the third table self-stabilizing system according to the embodiments of the present invention.

In another embodiment shown in FIGS. 7 and 8, a table 300 comprises a table top 310 supported by multiple spaced supports including at least two independent vertical supports 320-1, 320-2 and a third support 325 comprising a pair of legs 330-1, 330-2 separated by a horizontal member 335. Each vertical support 320-1, 320-2 includes a foot 322-1, 322-2 and third support 325 includes a pair of feet 327-1, 327-2. Each vertical support 320-1, 320-2 also includes a horizontal platform 324-1, 324-2 for attachment to the underside of the table top 310.

A stabilizing member 350 is configured to slip over horizontal member 335 and movably attached thereto. The stabilizing member 350 is further attached to the underside of the table top 310. Stabilizing member 350 comprises a body 355 configured to slip over the horizontal member 335 and a cross-member 360. In one embodiment, the body 355 is U-shaped (like the stabilizing device seen in FIG. 6A) to slip over the rectangular horizontal member 335.

When attached, as shown in FIG. 7, the stabilizing member 350 pivots about the connection point (not visible) with the horizontal member 335. The rocking motion of the stabilizing member 350 stabilizes the table 300 when on uneven ground.

Figure 9:
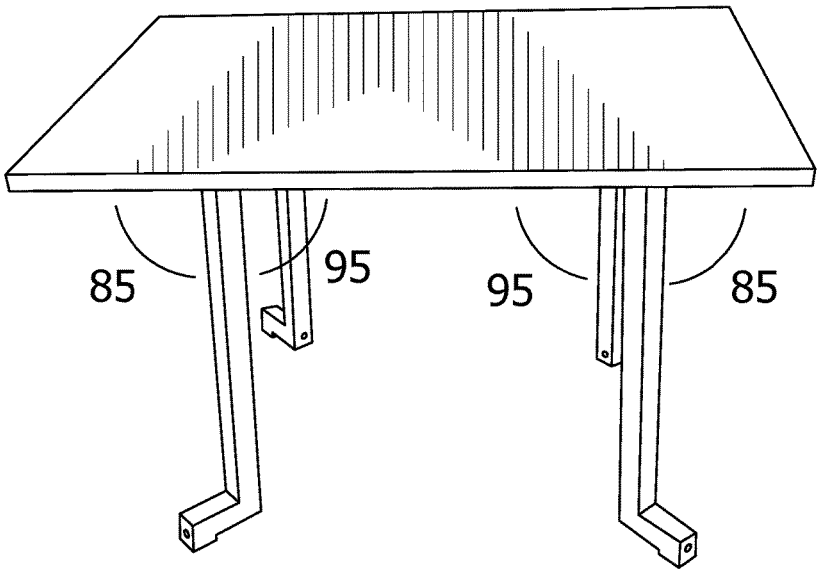
FIG. 9 illustrates a table and angles between a table top and supports according to the embodiments of the present invention.

In one embodiment, best shown in FIG. 9, the supports 225-1' through 225-4' extend upward at a slight angle rather than directly vertical. As shown in FIG. 9, the slight angle is 5° from vertical but it is obvious that the angle may be greater than 5° or less than 5°. The supports 225-1' through 225-4' extend upward and outward toward respective ends of the table top 310' such that the supports 225-1' through 225-4' and table top 310' do not form a right angle but rather 85° and 95° angles. This configuration results in a more stable table. This feature is useable with all embodiments of the present invention.

Although the invention has been described in detail with reference to several embodiments, additional variations and modifications exist within the scope and spirit of the invention.

I claim:

1. A table comprising:

a table top supported by two spaced supports proximate opposite edges of the table, each of said supports comprising a vertical member;

a first horizontal platform attached to a first one of said two spaced supports attached to an underside of said table top;

a second horizontal platform affixed to a post and attached to said underside of said table top, said post inserted into said vertical member of said second one of said spaced supports and movably joined via one or more fasteners at an upper end to said vertical member; and wherein said post may move side-to-side in a rocking manner within and relative to said vertical member and about said one or more fasteners thereby moving said second horizontal platform and table connected thereto.

2. The table of claim 1 further comprising at least a pair of legs extending from proximate a bottom of each support.

3. The table of claim 1 wherein said one or more fasteners comprise a nut and bolt combination that movably joins said post to an upper end of said vertical member such that post may move side-to-side in a rocking manner within and relative to said vertical member and about said one or more fasteners.

4. The table of claim 1 wherein said table top and each spaced support do not form a right angle.

5. A table comprising:

a table top supported by two spaced supports proximate opposite edges of the table, each of said supports comprising a pair of legs separated by a horizontal member attached to an underside of said table top; and a stabilizing member affixed to an underside of said table top and slipped over and movably attached via one or more fasteners to a connection point near a middle of one of said horizontal members of said two spaced supports such that said stabilizing member may pivot in a vertical plane about said connection point relative to said horizontal member to which said stabilizing member is attached thereby moving said table top attached thereto, a top of said stabilizing member being spaced above a top of said one of said horizontal members to which said stabilizing member is attached.

6. The table of claim 5 further comprising one or more cross-members affixed to said horizontal members or stabilizing member.

7. The table of claim 5 wherein said stabilizing member has a U-shaped body.

8. The table of claim 7 wherein said U-shaped body is dimensioned to slip over said one of said horizontal members of said two spaced supports.

9. The table of claim 5 further comprising feet at a bottom of each leg.

10. The table of claim 5 wherein said table top and each spaced support do not form a right angle.

11. A table comprising:

a table top supported by multiple spaced supports including at least two independent vertical supports attached to an underside said table top and a third support comprising a pair of legs separated by a horizontal member attached to an underside of said table top; and a stabilizing member affixed to an underside of said table top and slipped over and movably attached via one or more fasteners to a connection point near a middle of said third support such that said stabilizing member may pivot in a vertical plane relative to said horizontal member, a top of said stabilizing member being spaced above a top of said one of said third support structure to which said stabilizing member is attached.

12. The table of claim 11 further comprising a cross-member affixed to said stabilizing member.

13. The table of claim 11 wherein said stabilizing member has a U-shaped body.

14. The table of claim 13 wherein said U-shaped body is dimensioned to slip over said one of said horizontal members of said two spaced supports.

15. The table of claim 11 further comprising feet at a bottom of each leg.

16. The table of claim 11 further comprising a horizontal platform at a top of each vertical support.

17. The table of claim 11 wherein said table top and each spaced support do not form a right angle.

* * * * *